US009388815B2

(12) United States Patent
Chen et al.

(10) Patent No.: US 9,388,815 B2
(45) Date of Patent: Jul. 12, 2016

(54) MULTIPLE-CAPACITY CENTRIFUGAL COMPRESSOR AND CONTROL METHOD THEREOF

(71) Applicant: INDUSTRIAL TECHNOLOGY RESEARCH INSTITUTE, Chutung Township, Hsinchu County (TW)

(72) Inventors: Chun-Han Chen, Hsinchu (TW); Teng-Yuan Wu, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 795 days.

(21) Appl. No.: 13/744,937

(22) Filed: Jan. 18, 2013

(65) Prior Publication Data

US 2013/0189074 A1 Jul. 25, 2013

(30) Foreign Application Priority Data

Jan. 20, 2012 (TW) ..... 101102485 A

(51) Int. Cl.

| | |
|---|---|
| ***F01D 17/12*** | (2006.01) |
| ***F04D 17/10*** | (2006.01) |
| ***F04D 27/02*** | (2006.01) |
| ***F04D 17/12*** | (2006.01) |

(52) U.S. Cl.

CPC ..... *F04D 17/10* (2013.01); *F04D 17/12* (2013.01); *F04D 27/0246* (2013.01)

(58) Field of Classification Search

CPC ..... F04D 17/10; F04D 17/12; F04D 17/122; F04D 27/002; F04D 29/28; F04D 29/284; F04D 29/287

See application file for complete search history.

(56) References Cited

U.S. PATENT DOCUMENTS 4,151,725 A * 5/1979 Kountz ..... F04D 27/0246 417/19
4,152,902 A * 5/1979 Lush ..... F04C 28/02 236/1 E
4,257,733 A * 3/1981 Bandukwalla ..... F04D 29/464 415/13

(Continued)

FOREIGN PATENT DOCUMENTS

CN 201615076 U 10/2010
CN 101896773 A 11/2010

(Continued)

OTHER PUBLICATIONS

Gravdahl et al., "Centrifugal Compressor Surge and Speed Control", IEEE Transactions on Control Systems Technology, vol. 7, No. 5, Sep. 1999.

(Continued)

*Primary Examiner* — Eric Keasel
*Assistant Examiner* — Brian O Peters
(74) *Attorney, Agent, or Firm* — Rabin & Berdo, P.C.

(57) ABSTRACT

The present disclosure relates to a multiple-capacity centrifugal compressor, which includes a plurality of capacity-control mechanisms. Each of the capacity-control mechanisms includes an inlet guide vane and an outlet diffuser, so that the multiple-capacity centrifugal compressor provides a flexible control strategy. In addition, the present disclosure further provides a method for controlling the multiple-capacity centrifugal compressor that effectively adjusts and controls the capacity-control mechanisms by coarsely adjusting the inlet guide vanes and combined with subsequently adjusting the outlet diffusers.

17 Claims, 9 Drawing Sheets

(56) References Cited

U.S. PATENT DOCUMENTS

| | | | | | |
|---|---|---|---|---|---|
| 4,288,198 | A | * | 9/1981 | Hibino | F04D 27/02 415/1 |
| 4,562,531 | A | * | 12/1985 | Enterline | F04D 27/0207 415/27 |
| 4,616,483 | A | | 10/1986 | Leonard | |
| 4,780,049 | A | * | 10/1988 | Palmer | F04D 29/4213 415/149.1 |
| 5,618,160 | A | * | 4/1997 | Harada | F04D 27/0246 415/15 |
| 5,807,071 | A | | 9/1998 | Brasz et al. | |
| 5,873,696 | A | * | 2/1999 | Harada | F04D 27/0246 415/148 |
| 5,947,680 | A | * | 9/1999 | Harada | F04D 27/0284 415/17 |
| 6,129,511 | A | * | 10/2000 | Salvage | F01D 17/02 415/1 |
| 6,230,479 | B1 | | 5/2001 | Kawamura et al. | |
| 7,793,509 | B2 | | 9/2010 | Crane | |

FOREIGN PATENT DOCUMENTS

| | | | |
|---|---|---|---|
| CN | 102072186 | A | 5/2011 |
| JP | 9-68192 | A | 3/1997 |
| JP | 9-303291 | A | 11/1997 |
| JP | 2000291597 | A | 10/2000 |
| TW | 201030240 | A | 8/2010 |

OTHER PUBLICATIONS

Willems, "Modeling and control of compressor", Control Systems, IEEE, vol. 19, No. 5, pp. 8-18, Oct. 1999.

Chen et al., "The Aerodynamic Design for Centrifugal Compressor", Industrial Machinery Magazine, vol. 274, pp. 51-60, 1995.

Taiwan Patent Office, Office Action, Patent Application No. TW101102485, Sep. 11, 2014, Taiwan.

China Patent Office, Office Action issued on Feb. 3, 2015.

* cited by examiner

MULTIPLE-CAPACITY CENTRIFUGAL COMPRESSOR AND CONTROL METHOD THEREOF

CROSS-REFERENCE TO RELATED APPLICATION

The present application is based on, and claims priority from, Taiwan (International) Application Serial Number 101102485, filed Jan. 20, 2012, the disclosure of which is hereby incorporated by reference herein.

FIELD

The present disclosure relates to centrifugal compressors, and more particularly, to a multiple-capacity centrifugal compressor applicable to chillers and a control method thereof.

BACKGROUND

Refrigeration devices commonly used in existing air conditioning systems are chillers. Chilled water produced by a chiller passes through a channel and reduces ambient temperature by heat exchange. In recent years, chillers are widely used. One common type is a centrifugal chiller. The operating core is a centrifugal compressor. In order to save energy, multi-stage centrifugal compressors have become more common, but they exhibit non-proportionality in load control and poor capacity, adversely affecting control effects.

Referring to FIG. 1, the capacity-control performance of a traditional single-capacity centrifugal compressor is shown. As shown, when compared to the capacity-control performance of the system impedance line, this single-capacity centrifugal compressor (from overall flow 30% to overall flow 100%) cannot achieve a wide operation range for the system, so it is difficult for single-capacity centrifugal compressors to accomplish wide-range operations. In order to achieve wide-range operations, various multiple-capacity control methods are proposed. However, traditional multiple-capacity control methods usually involve adjusting a single inlet guide vane and a single diffuser. For simultaneous adjustments, only a fixed increment/decrement is provided. For sequential adjustments, one capacity-control mechanism is adjusted while the rest of the capacity-control mechanisms are unchanged, and another capacity-control mechanism is then adjusted only when the current one has reached its limit. Nonetheless, the above control schemes have less available control strategies and relatively poor control priority. As such, COP (coefficient of performance) is limited to be between 5.5 and 6.0, which only satisfies full-load efficiency, but not partial-load requirements, thereby reducing system efficiency and capacity.

U.S. Pat. No. 6,129,511 discloses a technique that controls only one set of an inlet guide vane and a diffuser by obtaining characteristic curves from actual measurements to know the relationships between the inlet guide vane and the diffuser and to establish a database thereof, thereby adjusting inlet guide vane in cooperation with the diffuser including inner and outer rings. Also, by measuring pressures, adjustment can be made through stepless control and interpolation, resulting in a compressor with high compression ratio. However, this type of control has less available variables and low flexibility. The overall control strategy is limited, which in turn limits the COP performance.

Moreover, U.S. Pat. No. 4,616,483 similarly adjusts a set of an inlet guide vane and a diffuser by controlling pressure values within a desired range in sequential increments or decrements based on measure current. Although this type of control method is simple and easy to use, it fails to provide wide-range operations and satisfy partial-load operations.

Furthermore, U.S. Pat. No. 5,807,071 similarly adjusts a set of an inlet guide vane and a diffuser. More specifically, the changes in the flow of refrigerant are controlled by the variable inlet guide vane in conjunction with rotating of inner and outer rings of the diffuser to turn on/off flow channel therein, thereby maintaining the compressor at peak efficiency, while suppressing surges. Also, the control is done sequentially based on the characteristic curves. However, this type of control has less available variables, and thus the overall control strategy is limited, which in turn limits the COP performance. It also fails to provide wide-range operations and satisfy partial-load operations.

From the above, it is clear that in the case of adjusting a set of an inlet guide vane and a diffuser in the prior art, it is difficult to achieve wide-range operations and satisfy partial-load operations. Moreover, the traditional multiple-capacity control techniques fail to provide a centrifugal compressor that improves the overall machine efficiency and suppresses surges. Thus, there is a need to provide a multiple-capacity centrifugal compressor and a control method thereof, which achieve proportionality in load control in the multi-stage centrifugal compressor and ensure wide-range operations, while increasing overall machine efficiency and reducing surges for safety and reliability.

SUMMARY

The present disclosure provides a multiple-capacity centrifugal compressor, which may include: a plurality capacity-control mechanisms respectively having an inlet guide vane and an outlet diffuser; and a controller for controlling the plurality of capacity-control mechanisms, wherein the controller calculates a pressure ratio of a pressure of the outlet diffuser to a pressure of the inlet guide vane of each capacity-control mechanism based on the pressure of the inlet guide vane and the pressure and the temperature of the outlet diffuser, and compares changes in the pressure ratios of the capacity-control mechanisms to determine a control priority for the capacity-control mechanisms, and adjusts the inlet guide vanes and outlet diffusers of the capacity-control mechanisms based on the determined control priority.

The present disclosure further provides a method for controlling a multiple-capacity centrifugal compressor. The multiple-capacity centrifugal compressor includes at least two capacity-control mechanisms, and each capacity-control mechanism includes an inlet guide vane and an outlet diffuser. The method may include the following steps: (1) sensing the a pressures of the inlet guide vane and a pressure and a temperature of the outlet diffuser of each capacity-control mechanism; (2) calculating a pressure ratio of the pressure of the outlet diffuser to the pressure of the inlet guide vane of each capacity-control mechanism; (3) comparing changes in the pressure ratios of the capacity-control mechanisms to determine a control priority for the capacity-control mechanisms; (4) adjusting the inlet guide vanes of the capacity-control mechanisms based on the determined control priority; and (5) adjusting the outlet diffusers of the capacity-control mechanisms based on the determined control priority.

In addition, in another embodiment of the present disclosure, the pressures of the inlet guide vanes and the pressures and temperatures of the outlet diffusers are continuously sensed using pre-arranged temperature sensors and pressure sensors.

In yet another embodiment of the present disclosure, the step of determining the control priority for the capacity-control mechanisms may include determining an adjusting order and an adjusting level of the capacity-control mechanisms.

Furthermore, in still another embodiment of the present disclosure, the step of adjusting the outlet diffuser of the capacity-control mechanism may further include reading a current position value and a current temperature of the outlet diffuser; determining whether the position value of the outlet diffuser reaches an upper limit, if so, then negatively searching for a temperature reversal point; else, positively searching for a temperature reversal point; and adjusting the position value of the outlet diffuser based on the obtained temperature reversal point.

BRIEF DESCRIPTION OF THE DRAWINGS

The present disclosure can be more fully understood by reading the following detailed description of the preferred embodiments, with reference made to the accompanying drawings, wherein.

DETAILED DESCRIPTION OF THE EMBODIMENTS

The present disclosure is described by the following specific embodiments. Those with ordinary skills in the arts can readily understand the other advantages and functions of the present disclosure after reading the disclosure of this specification. The present disclosure can also be implemented with different embodiments. Various details described in this specification can be modified based on different viewpoints and applications without departing from the scope of the present disclosure.

It should be noted that the structures, proportions and sizes shown in the attached drawings are only used in conjunction with the disclosure of the specification to facilitate one skilled in the art in understanding and reading thereof, and should not be construed as to limit the present disclosure, and carry no technical significance. Any modifications made to the structures, proportions and sizes fall within the scope of the present disclosure. Terms such as "first," "second," "at least one," and "a plurality of" used herein are for illustrative purpose only, and are not used to limit the scope of the present disclosure. Changes and modifications to their relative relationships should be regarded as encompassed by the scope of the present disclosure.

A multiple-capacity centrifugal compressor and a control method thereof proposed by the present disclosure overcomes low overall machine efficiency due to poor proportionality in load control in the prior art by providing flexible and adjustable capacity-control strategies in multi-stage centrifugal compressors. In the present disclosure, there is proportional relationship between capacity-control mechanism and load changes, and each capacity-control mean can maintain a better aperture, thereby enhancing system efficiency and capability and allowing wide-range operations.

Figure 1:
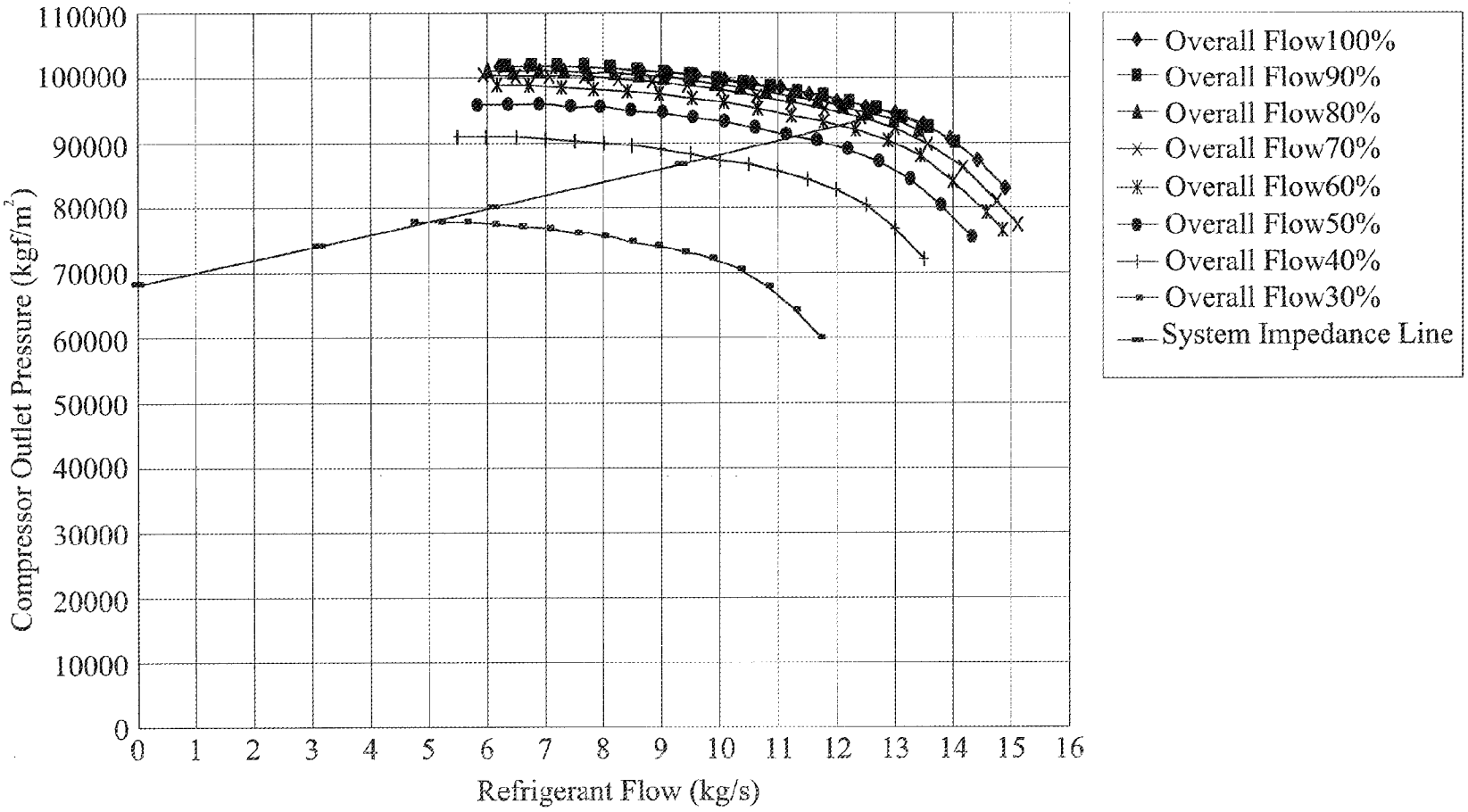
FIG. 1 (PRIOR ART)
FIG. 1 is a graph depicting the capacity-control performance of a traditional single-capacity centrifugal compressor.
Figure 2:
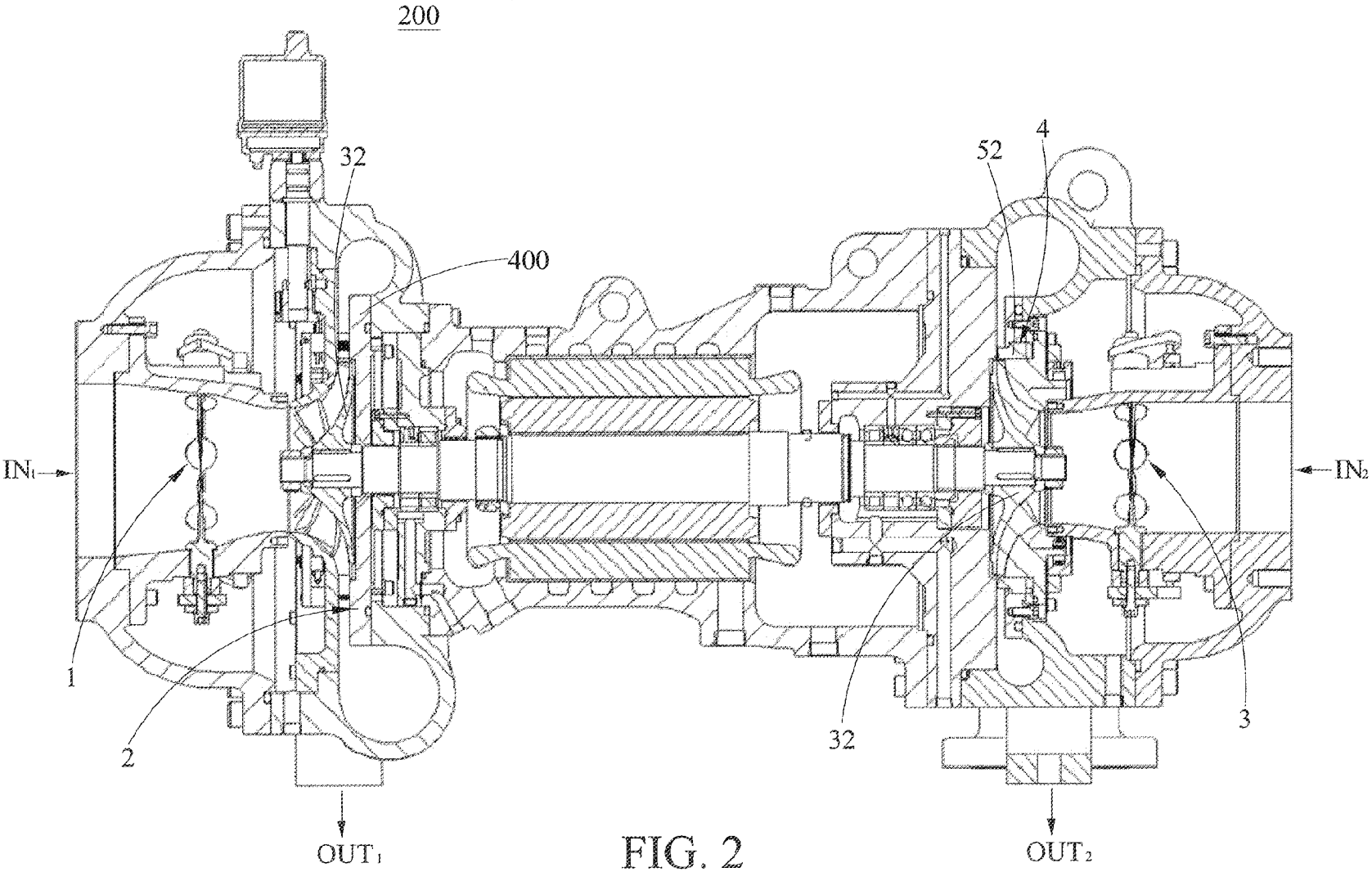
FIG. 2 is a cross-sectional diagram of a multiple-capacity centrifugal compressor according to an embodiment of the present disclosure.

FIG. 2 shows a cross-sectional view of a multiple-capacity centrifugal compressor 200 according to an embodiment of the present disclosure. The multiple-capacity centrifugal compressor 200 includes a first-stage inlet $IN_1$, a first-stage outlet $OUT_1$, a second-stage inlet $IN_2$, and a second-stage outlet $OUT_2$. As shown, the multiple-capacity centrifugal compressor 200 includes a first inlet guide vane (such as an inlet guide vane 300 with blades 32 shown in FIGS. 3A and 3B), a second inlet guide vane (such as the inlet guide vane 300 with the blades 32 shown in FIGS. 3A and 3B), a first outlet diffuser 400 (such as those shown in FIGS. 4A and 4B) and a second outlet diffuser 52 (such as those shown in FIGS. 5A and 5B) located at positions 1, 3, 2 and 4, respectively. However, in other embodiments, the first outlet diffuser can be replaced by the outlet diffuser 52 shown in FIGS. 5A and 5B, and the second outlet diffuser can similarly be replaced by the outlet diffuser 400 shown in FIGS. 4A and 4B.

The first inlet guide vane is disposed at position 1, which is a first-stage inlet of the multiple-capacity centrifugal compressor 200, and the pressure at the first inlet guide vane (position 1) is $P_{1-1}$. The second inlet guide vane is disposed at position 3, which is a second-stage inlet of the multiple-capacity centrifugal compressor 200, and the pressure at the second inlet guide vane (position 2) is $P_{2-1}$. The first outlet diffuser is disposed at position 2, which is a first-stage outlet of the multiple-capacity centrifugal compressor 200, and the temperature and pressure at the first outlet diffuser (position 2) are $T_{1-2}$ and $P_{1-2}$, respectively. The second outlet diffuser is disposed at position 4, which is a second-stage outlet of the multiple-capacity centrifugal compressor 200, and the temperature and pressure at the second outlet diffuser (position 4) are $T_{2-2}$ and $P_{2-2}$, respectively.

Figure 10:
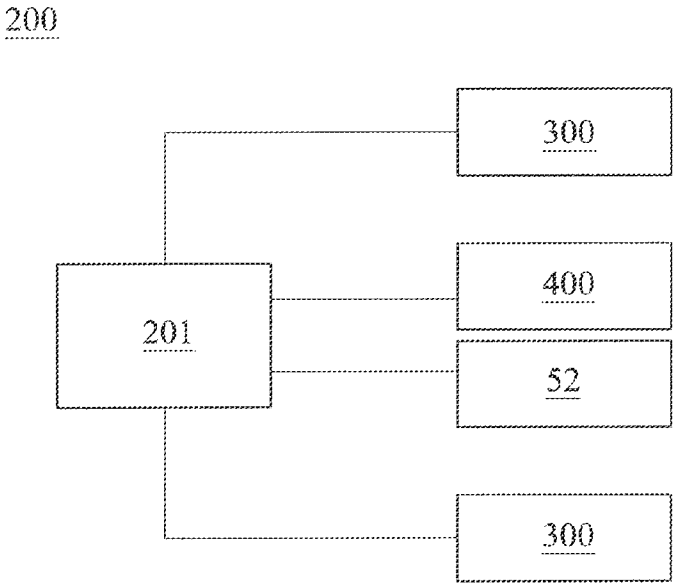
FIG. 10 is a functional diagram of a multiple-capacity centrifugal compressor according to the present disclosure.

The multiple-capacity centrifugal compressor 200 may further include a controller 201 (shown in FIG. 10, which is functional diagram of the multiple-capacity centrifugal compressor 200 according to the present disclosure) for measuring the temperatures and pressures at positions 1, 2, 3 and 4. Based on the measurements, a first-stage pressure ratio $P_{r1}$ and a second-stage pressure ratio $P_{r2}$ can be calculated, wherein $P_{r1}=P_{1-2}/P_{1-1}$ and $P_{r2}=P_{2-2}/P_{2-1}$.

The multiple-capacity centrifugal compressor 200 may further include a controller (not shown) for controlling the plurality of capacity-control mechanisms (that is, the first and second inlet guide vanes and the first and second outlet diffusers). The controller calculates the pressure ratios ($P_{r1}$ and $P_{r2}$) of the outlet diffusers to the inlet guide vanes of the capacity-control mechanisms based on the pressure of the inlet guide vanes ($P_{1-1}$ and $P_{2-1}$) and the pressure and the temperature of the outlet diffusers ($P_{1-2}$ and $T_{1-2}$; $P_{2-2}$ and $T_{2-2}$). The controller then compares changes in the pressure ratios ($P_{r1}$ and $P_{r2}$) of the capacity-control mechanisms to determine control priority for the capacity-control mechanisms. Based on the determined control priority, the inlet guide vanes are controlled, that is, the apertures of the inlet guide vanes are adjusted (adjustable range is between 0% and 100%). Upon completing the adjustment of the inlet guide vanes, the controller may further control the diffusers to work in a better state.

More specifically, the controller reads the current position value (current apertures) of each outlet diffuser and the current temperature. Then, the controller determines whether the aperture of each outlet diffuser reaches an upper limit. If the aperture of the outlet diffuser reaches the upper limit, then a temperature reversal point is negatively searched, which will be discussed later. If the aperture of the outlet diffuser has not yet reached the upper limit, then a temperature reversal point is positively searched, which will be discussed later. Based on the obtained temperature reversal point, the position values of the outlet diffusers are adjusted, respectively.

In other words, the controller determines the control priority based on the changes in the pressure ratios of the capacity-control mechanisms, that is, the order in which the capacity-control mechanisms are adjusted and the level of adjustment of each capacity-control mechanism can be determined. More specifically, the inlet guide vanes are adjusted based on the control priorities and then based on the obtained temperature reversal points, the position values of the outlet diffusers are adjusted. In other words, the controller coarsely adjusts the inlet guide vanes, and then fine tunes the outlet diffusers.

The above multiple-capacity centrifugal compressor 200 is exemplified as, but not limited to, a two-stage compressor. For example, the multiple-capacity centrifugal compressor 200 may also be a compressor with more stages or more capacity-control mechanisms, or the capacity-control mechanisms are adjusted using different controlling means (e.g., cool water flow, power consumption etc.).

For example, in another embodiment of the present disclosure, the multiple-capacity centrifugal compressor 200 may be provided with a flow sensor (not shown) for sensing cool water that flows through positions 1 and 2 and positions 3 and 4. Since positions 1 and 2 correspond to the first-stage inlet and the first-stage outlet, and positions 3 and 4 correspond to the second-stage inlet and the second-stage outlet, the amount of water flowing through positions 1 and 2 should be equal, and the amount of water flowing through positions 3 and 4 should be equal.

The multiple-capacity centrifugal compressor 200 may further include a controller for controlling the plurality of capacity-control mechanisms (that is, the first and second inlet guide vanes and the first and second outlet diffusers). The controller determines the cool water flow flowing through the first stage (positions 1 and 2) and the second stage (positions 3 and 4), and compares changes in the cool water flow of the two stages to determine control priority for the two stages (the capacity-control mechanisms). Based on the determined control priority, the inlet guide vanes are controlled, that is, the apertures of the inlet guide vanes are adjusted (adjustable range is between 0% and 100%). More specifically, the controller reads the current position values (current apertures) of the outlet diffusers and the current cool water flow, and then determines whether the apertures of the outlet diffusers reach an upper limit, respectively. If the aperture of the outlet diffuser reaches the upper limit, then a temperature reversal point is negatively searched, which will be discussed later. If the aperture of the outlet diffuser has not yet reached the upper limit, then a temperature reversal point is positively searched, which will be discussed later. Based on the obtained temperature reversal point, the position values of the outlet diffusers are adjusted, respectively.

It can be seen that the controller can determine control priorities based on the changes in the changes in the cool water flow of the capacity-control mechanisms (positions 1 and 2 and positions 3 and 4). Similarly, first the inlet guide vane of each set is adjusted based on the control priority. Thereafter, based on the obtained temperature reversal points, the position values of the outlet diffusers are adjusted.

Moreover, in the above embodiments, the multiple-capacity centrifugal compressor 200 may be provided with a power sensor (not shown) for sensing the power consumed at the first stage (positions 1 and 2) and the second stage (positions 3 and 4). Then, as described in the previous embodiments, the controller compares the changes of power consumed at the two stages to determine the control priority for the two stages (the capacity-control mechanisms).

Figure 3B:
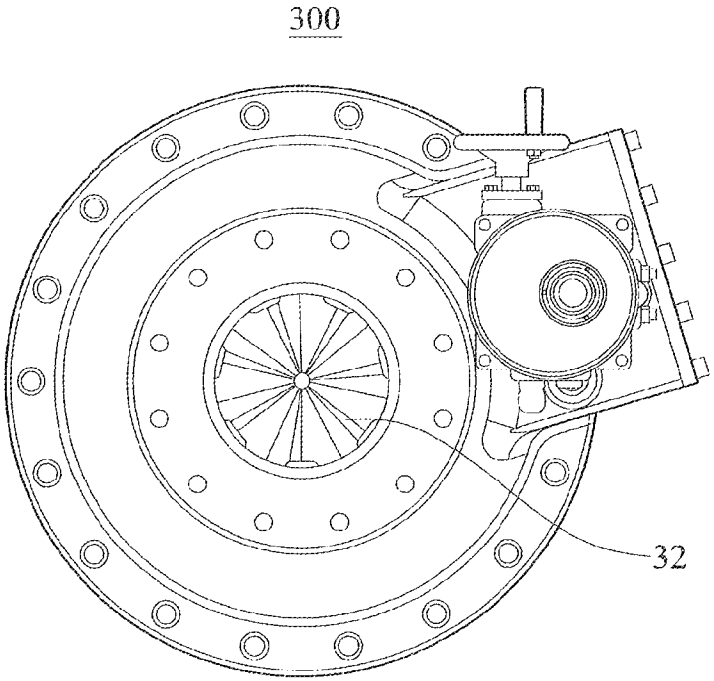
FIG. 3B is a schematic diagram depicting an inlet guide vane used in the multiple-capacity centrifugal compressor shown in FIG. 2 when opened 0%.
Figure 3A:
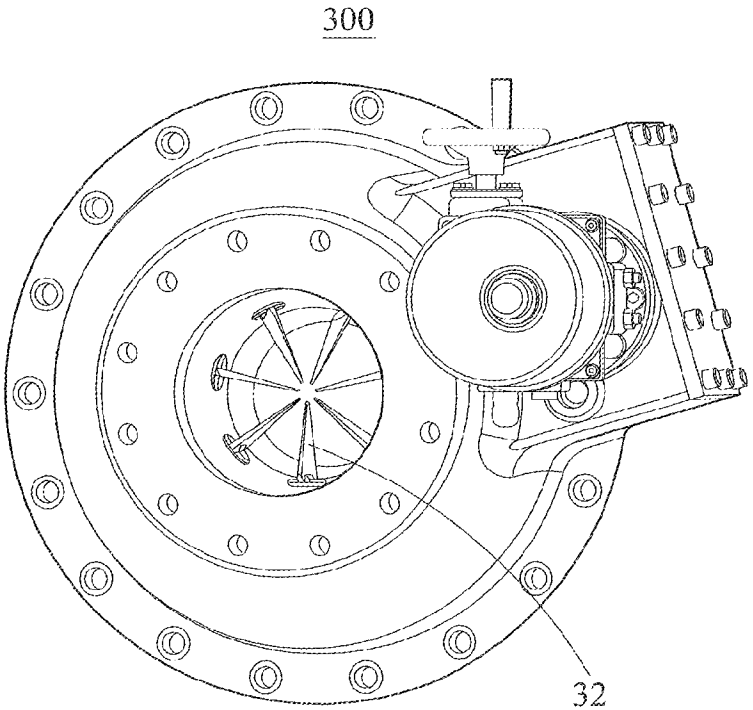
FIG. 3A is a schematic diagram depicting an inlet guide vane used in the multiple-capacity centrifugal compressor shown in FIG. 2 when opened 100%.

FIGS. 3A and 3B show the inlet guide vane 300 used in the multiple-capacity centrifugal compressor 200 of FIG. 2 with different apertures, respectively. As shown, the aperture of the inlet guide vane 300 is controlled through blades 32, ranging from 0% to 100%.

Figure 4B:
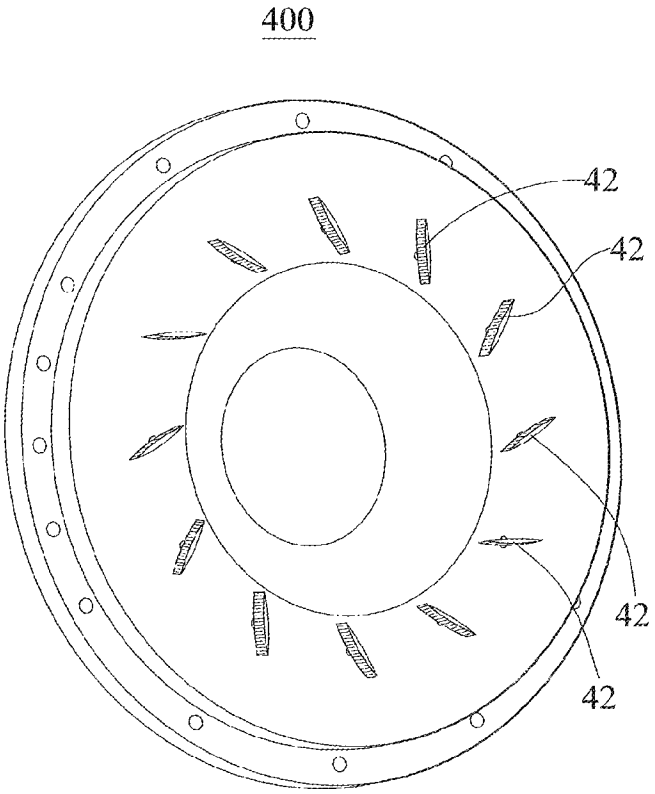
FIG. 4B is a schematic diagram depicting a diffuser used in the multiple-capacity centrifugal compressor shown in FIG. 2 when opened 100%.
Figure 4A:
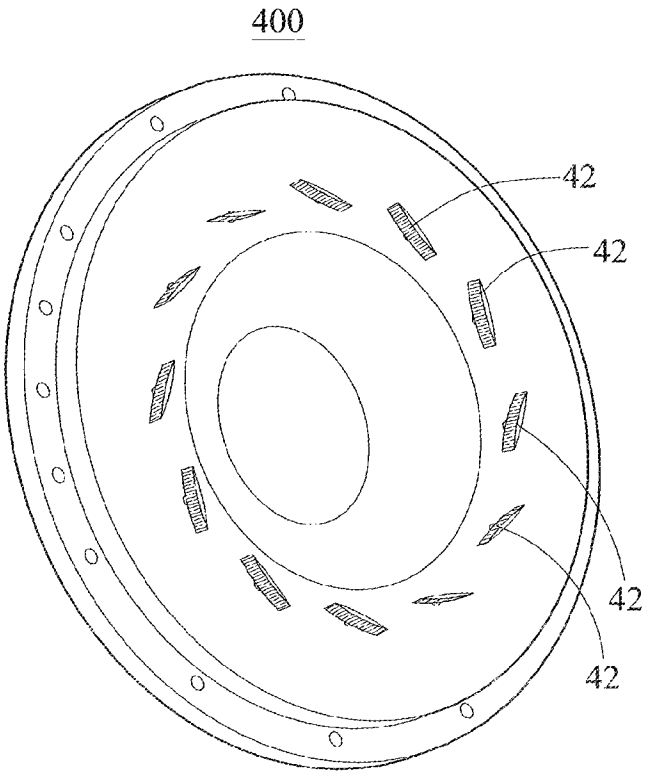
FIG. 4A is a schematic diagram depicting a diffuser used in the multiple-capacity centrifugal compressor shown in FIG. 2 when opened 0%.

Referring to FIGS. 4A and 4B, the outlet diffuser 400 used in the multiple-capacity centrifugal compressor 200 of FIG. 2 with different apertures are shown, respectively. As shown, the aperture of the outlet diffuser 400 is controlled through adjusting blades 42, ranging from 0% to 100%.

Figure 5B:
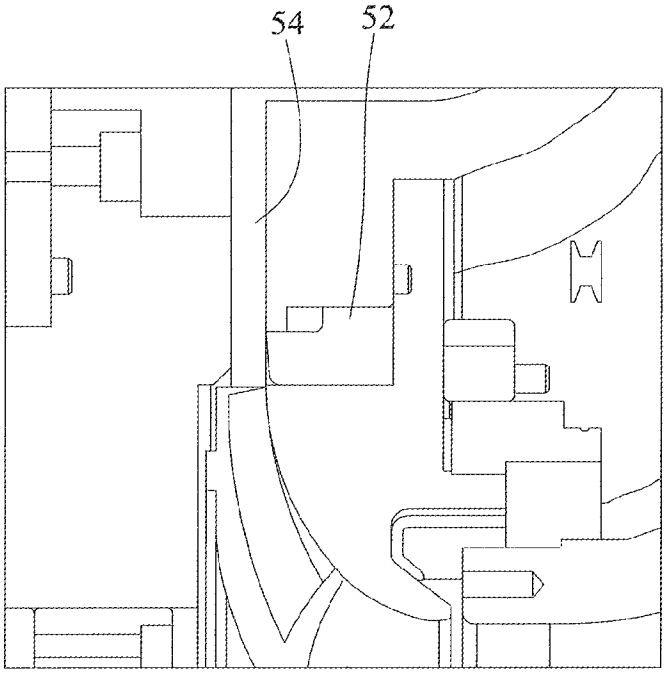
FIG. 5B is a schematic diagram depicting the another type of a diffuser used in the multiple-capacity centrifugal compressor shown in FIG. 2 when opened 100%.
Figure 5A:
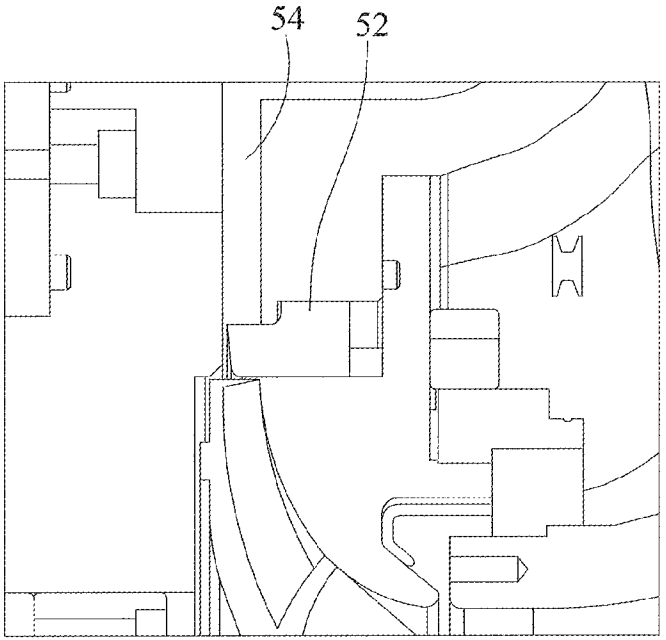
FIG. 5A is a schematic diagram depicting another type of a diffuser used in the multiple-capacity centrifugal compressor shown in FIG. 2 when opened 0%.

Referring to FIGS. 5A and 5B, the diffuser 52 (diffuser slider) used in the multiple-capacity centrifugal compressor 200 of FIG. 2 with different apertures are shown. As shown, the level of opening (aperture) of a channel 54 is controlled through displacements of the diffuser 52, ranging from 0% to 100%.

Figure 6:
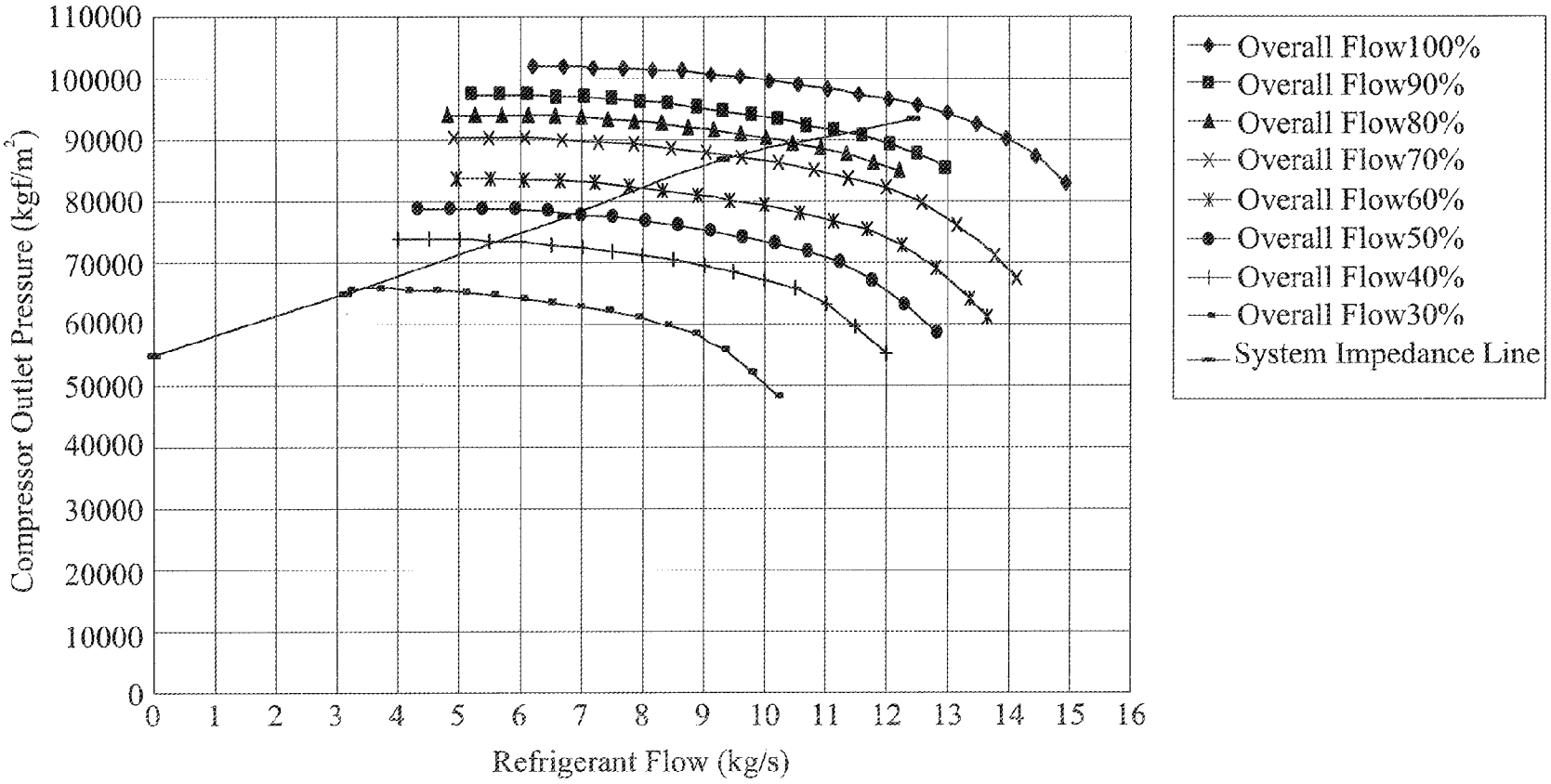
FIG. 6 is a graph depicting the capacity-control performance of a multiple-capacity centrifugal compressor according to the present disclosure.

Referring to FIG. 6, the capacity-control performance of a multiple-capacity centrifugal compressor is shown. In the present disclosure, the first inlet guide vane (IGV1) and second inlet guide vane (IGV2) are combined to achieve the shown capacity-control performance of overall flow 30% to overall flow 100% compared to the system impedance line. As a result, the multiple-capacity centrifugal compressor of the present disclosure provides a more flexible control strategy. As shown, the multiple-capacity centrifugal compressor of the present disclosure enables the system to operate in a wider operating range. Compared to the capacity-control techniques of the prior art, the multiple-capacity centrifugal compressor of the present disclosure significantly offers a broader operating range, thereby maintaining each capacity-control mechanism with a better aperture and increasing system efficiency and capability as well as proportionality.

Figure 7:
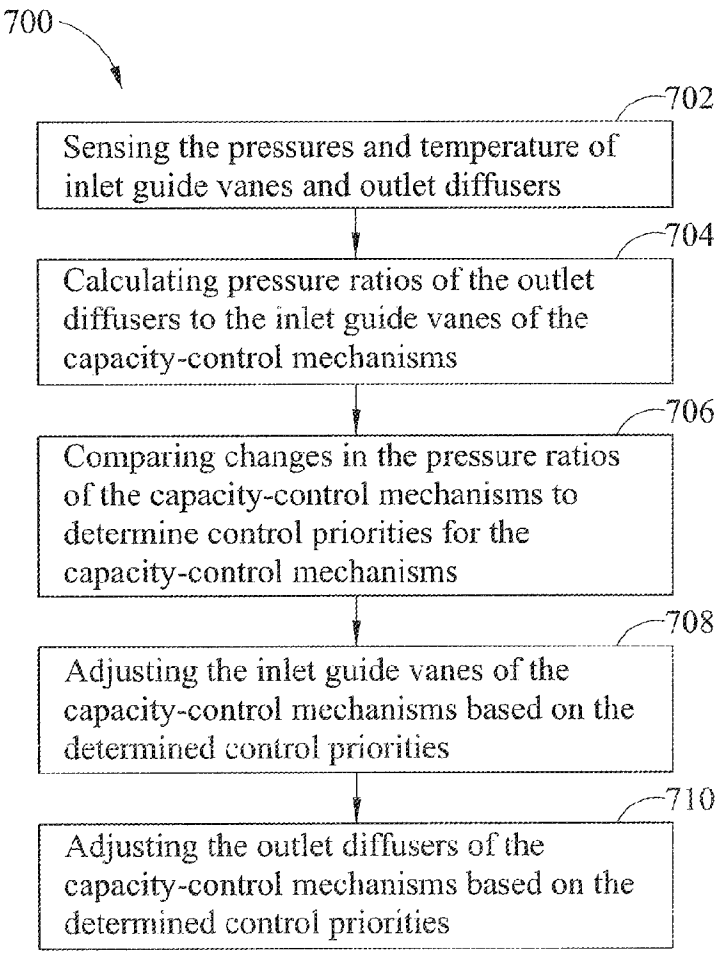
FIG. 7 is a flow chart illustrating a method for controlling a multiple-capacity centrifugal compressor according to the present disclosure.

FIG. 7 is a flow chart illustrating a method for controlling a multiple-capacity centrifugal compressor 700 according to the present disclosure. It is described in FIG. 7 that the pressure ratio of the pressure of the outlet diffuser to the pressure of the inlet guide vane of the capacity-control mechanism are used as the control mechanism, but the present disclosure is not limited to this. Other control mechanism can also be used (e.g., cool water flow or power consumption etc.). In step 702, the pressures and temperature of the inlet guide vanes and the outlet diffusers are sensed. Then, proceed to step 704.

In step 704, the pressure ratio of the pressure of the outlet diffuser to the pressure of the inlet guide vane of each capacity-control mechanisms is calculated. Then, proceed to step 706.

In step 706, the changes in the pressure ratios of the capacity-control mechanisms are compared to determine control priority for the capacity-control mechanisms. Then, proceed to step 708.

In step 708, the inlet guide vanes of the capacity-control mechanisms are adjusted based on the determined control priority. Then, proceed to step 710.

In step 710, the outlet diffusers of the capacity-control mechanisms are adjusted based on the determined control priority.

Figure 8:
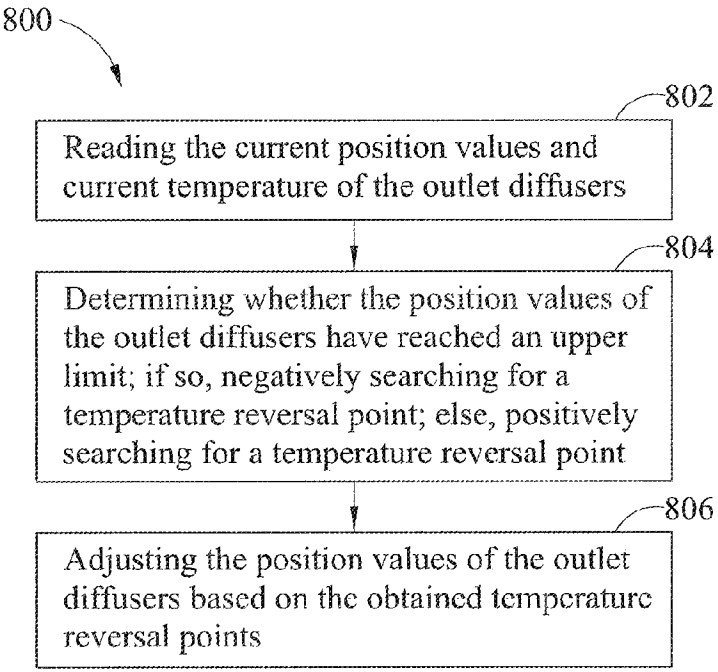
FIG. 8 is a flow chart illustrating a method for controlling a multiple-capacity centrifugal compressor according to the present disclosure.

In another embodiment of the present disclosure, the outlet diffusers of the capacity-control mechanisms are adjusted based on the determined control priorities by coarsely adjusting the inlet guide vanes, and then fine tuning the outlet diffusers based on the control priority, which is shown in FIG. 8 in more details.

Referring to FIG. 8, a flow chart illustrating a method for controlling a multiple-capacity centrifugal compressor 800 according to the present disclosure is shown. First, in step 802, the current position values and current temperature of the outlet diffuser are read.

In step 804, it is determined whether the position value (aperture) of each outlet diffuser reaches an upper limit. If so, then a temperature reversal point is negatively searched; else, a temperature reversal point is positively searched. Then, proceed to step 806.

In step 806, based on the obtained temperature reversal points, the position values of the outlet diffusers are adjusted, respectively.

In an embodiment of the present disclosure, a temperature reversal point is negatively searched by reducing the aperture of the outlet diffuser when the temperature of the outlet diffuser is increased, and increasing the aperture of the outlet diffuser when the temperature of the outlet diffuser is decreased. Similarly, in an embodiment of the present disclosure, a temperature reversal point is positively searched by increasing the aperture of the outlet diffuser when the temperature of the outlet diffuser is increased, and reducing the aperture of the outlet diffuser when the temperature of the outlet diffuser is reduced. Moreover, a detailed process of positively or negatively searching for a temperature reversal point described in step 804 is shown in FIG. 9.

Figure 9:
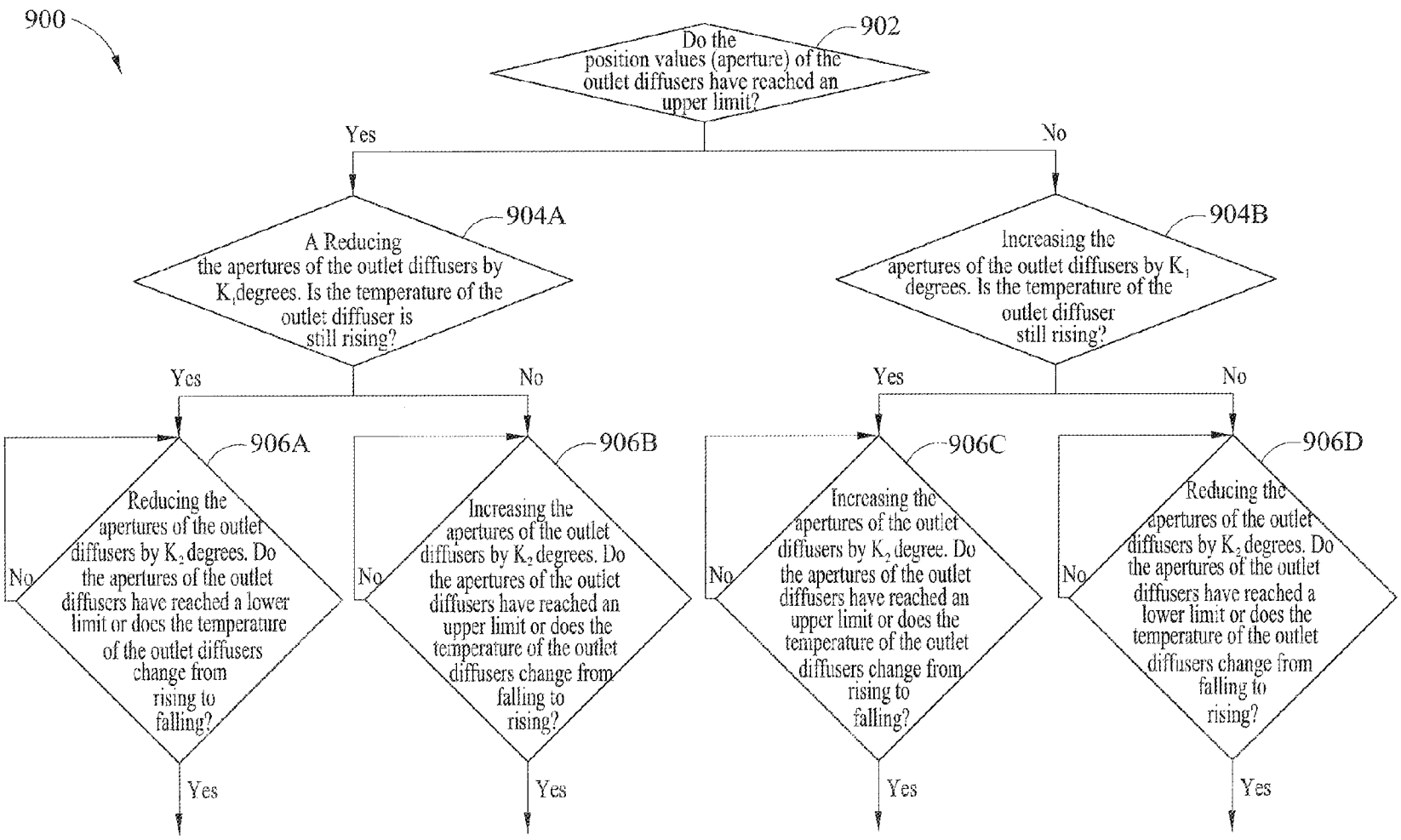
FIG. 9 is a flow chart illustrating a method for searching a temperature reversal point in the method for controlling a multiple-capacity centrifugal compressor according to the present disclosure.

Referring to FIG. 9, a flow chart illustrating a method for searching for a temperature reversal point is shown. In step 902, it is determined whether the position value (aperture) of the outlet diffuser reaches an upper limit. If so, then proceed to step 904A; else, proceed to step 904B. In step 904A, the aperture of the outlet diffuser is reduced by $K_1$ degrees (the value of $K_1$ may vary depending on system requirements), and it is determined whether the temperature of the outlet diffuser is still increased. If so, then proceed to step 906A; else, proceed to step 906B.

In step 904B, the aperture of the outlet diffuser is increased by $K_1$ degrees (the value of $K_1$ may vary depending on system requirements), and it is determined whether the temperature of the outlet diffuser is still increased. If so, then proceed to step 906C; else, proceed to step 906D.

In step 906A, the aperture of the outlet diffuser is reduced by $K_2$ degrees (the value of $K_2$ may vary depending on system requirements), and it is determined whether the aperture of the outlet diffuser reaches a lower limit or whether the temperature of the outlet diffuser starts to decrease. If so, then the aperture of the outlet diffuser at this point is determined to be the temperature reversal point; else, repeat step 906A. In other words, if the aperture of the outlet diffuser has not yet reached the lower limit or the temperature of the outlet diffuser is still increased, then the aperture of the outlet diffuser is further reduced until the aperture of the outlet diffuser reaches the lower limit or the temperature of the outlet diffuser starts to decrease, and the aperture of the outlet diffuser at this point is determined to be the temperature reversal point.

In step 906B, the aperture of the outlet diffuser is increased by $K_2$ degrees (the value of $K_2$ may vary depending on system requirements), and it is determined whether the aperture of the outlet diffuser reaches an upper limit or whether the temperature of the outlet diffuser starts to increase. If so, then the aperture of the outlet diffuser at this point is determined to be the temperature reversal point; else, repeat step 906B. In other words, if the aperture of the outlet diffuser has not yet reached the upper limit or the temperature of the outlet diffuser is still decreased, then the aperture of the outlet diffuser is further increased until the aperture of the outlet diffuser reaches the upper limit or the temperature of the outlet diffuser starts to increase, and the aperture of the outlet diffuser at this point is determined to be the temperature reversal point.

In step 906C, the aperture of the outlet diffuser is increased by $K_2$ degrees (the value of $K_2$ may vary depending on system requirements), and it is determined whether the aperture of the outlet diffuser reaches an upper limit or whether the temperature of the outlet diffuser starts to decrease. If so, then the aperture of the outlet diffuser at this point is determined to be the temperature reversal point; else, repeat step 906C. In other words, if the aperture of the outlet diffuser has not yet reached the upper limit or the temperature of the outlet diffuser is still increased, then the aperture of the outlet diffuser is further increased until the aperture of the outlet diffuser reaches the upper limit or the temperature of the outlet diffuser starts to decrease, and the aperture of the outlet diffuser at this point is determined to be the temperature reversal point.

In step 906D, the aperture of the outlet diffuser is reduced by $K_2$ degrees (the value of $K_2$ may vary depending on system requirements), and it is determined whether the aperture of the outlet diffuser reaches a lower limit or whether the temperature of the outlet diffuser starts to increase. If so, then the aperture of the outlet diffuser at this point is determined to be the temperature reversal point; else, repeat step 906D. In other words, if the aperture of the outlet diffuser has not yet reached the lower limit or the temperature of the outlet diffuser is still decreased, then the aperture of the outlet diffuser is further reduced until the aperture of the outlet diffuser reaches the lower limit or the temperature of the outlet diffuser starts to increase, and the aperture of the outlet diffuser at this point is determined to be the temperature reversal point.

After the temperature reversal point is obtained, the position value of the outlet diffuser is adjusted based on the obtained temperature reversal point. In addition, in another embodiment of the present disclosure, after completing steps 906A, 906B, 906C or 906D, the position value (aperture) of the outlet diffuser may be fine-tuned (e.g., increased/decreased by 0 to 10 degrees), depending on system requirements.

From the descriptions given above, it should be understood that compared to the prior art, the present disclosure achieves proportionality in load control, and ensures safety by suppressing surges through adjusting the diffusers, raising overall machine efficiency and allowing wide-range operations. Thus, the present disclosure offers significant improvements than the prior art in terms of operating efficiency or energy efficiency.

The above embodiments are only used to illustrate the principles of the present disclosure, and they should not be construed as to limit the present disclosure in any way. The above embodiments can be modified by those with ordinary skill in the art without departing from the scope of the present disclosure as defined in the following appended claims.

What is claimed is:

1. A multiple-capacity centrifugal compressor, comprising:

a plurality of capacity-control mechanisms each of which includes an inlet guide vane and an outlet diffuser; and a controller that calculates a pressure ratio of a pressure of the outlet diffuser to a pressure of the inlet guide vane of each of the capacity-control mechanisms based on the pressure of the inlet guide vane and the pressure and a temperature of the outlet diffuser, compares changes in the pressure ratios of the capacity-control mechanisms to determine control priority for the capacity-control mechanisms, and adjusts the inlet guide vane and outlet diffuser of the each of the capacity-control mechanisms based on the control priority, to control the plurality of capacity-control mechanisms, wherein the control priority for the capacity-control mechanisms includes an adjusting order and an adjusting level of the capacity-control mechanisms.

2. The multiple-capacity centrifugal compressor of claim 1, wherein the controller adjusts the inlet guide vane of each of the capacity-control mechanisms by adjusting an aperture of the inlet guide vane.

3. The multiple-capacity centrifugal compressor of claim 1, wherein the controller adjusts the outlet diffuser of the each of the capacity-control mechanisms by reading a current position value and a current temperature of the outlet diffuser, determining whether the position value of the outlet diffuser reaches an upper limit, searching for a temperature reversal point, and adjusting the position value of the outlet diffuser based on the obtained temperature reversal point.

4. The multiple-capacity centrifugal compressor of claim 3, wherein the searching for the temperature reversal point includes positively searching for a temperature reversal point and negatively searching for a temperature reversal point.

5. The multiple-capacity centrifugal compressor of claim 4, wherein the negatively searching for the temperature reversal point includes reducing the aperture of the outlet diffuser when the temperature of the outlet diffuser is increased.

6. The multiple-capacity centrifugal compressor of claim 4, wherein the negatively searching for the temperature reversal point includes increasing the aperture of the outlet diffuser when the temperature of the outlet diffuser is decreased.

7. The multiple-capacity centrifugal compressor of claim 4, wherein the positively searching for the temperature reversal point includes increasing the aperture of the outlet diffuser when the temperature of the outlet diffuser is increased.

8. The multiple-capacity centrifugal compressor of claim 4, wherein the positively searching for the temperature reversal point includes reducing the aperture of the outlet diffuser when the temperature of the outlet diffuser is decreased.

9. A method for controlling a multiple-capacity centrifugal compressor that includes two capacity-control mechanisms respectively having an inlet guide vane and an outlet diffuser, the method comprising the following steps of:

(1) sensing a pressure of the inlet guide vane and a pressure and a temperature of the outlet diffusers;

(2) calculating a pressure ratio of the pressure of the outlet diffuser to the pressure of the inlet guide vane of each of the capacity-control mechanisms;

(3) comparing changes in the pressure ratios of the capacity-control mechanisms to determine control priority for the capacity-control mechanisms;

(4) adjusting the inlet guide vanes of the capacity-control mechanisms based on the control priority; and (5) adjusting the outlet diffusers of the capacity-control mechanisms based on the control priority, wherein step (3) further includes determining an adjusting order and an adjusting amount of the capacity-control mechanisms.

10. The method of claim 9, wherein step (1) further includes continuously sensing the pressure of the inlet guide vane and the pressure and temperature of the outlet diffuser by using a pre-arranged temperature sensor and a pressure sensor.

11. The method of claim 9, wherein step (4) further includes adjusting apertures of the inlet guide vanes.

12. The method of claim 9, wherein step (5) further includes:

(5-1) reading a current position value and a current temperature of the outlet diffuser;

(5-2) determining whether the position value of the outlet diffuser reaches an upper limit; if so, negatively searching for a temperature reversal point; else, positively searching for a temperature reversal point; and (5-3) adjusting the position value of the outlet diffuser based on the temperature reversal point.

13. The method of claim 12, wherein the step of negatively searching for a temperature reversal point further includes:

when the temperature of the outlet diffusers is increased or continuously increased, reducing or continuously reducing the aperture of the outlet diffuser until the aperture of the outlet diffuser reaches a lower limit or the temperature of the outlet diffuser starts to decrease, and determining the aperture of the outlet diffuser at this point to be the temperature reversal point.

14. The method of claim 12, wherein the step of negatively searching for a temperature reversal point further includes:

when the temperature of the outlet diffuser is decreased, increasing or continuously increasing the aperture of the outlet diffuser until the aperture of the outlet diffuser reaches an upper limit or the temperature of the outlet diffuser starts to increase, and determining the aperture of the outlet diffuser at this point to be the temperature reversal point.

15. The method of claim 12, wherein the step of positively searching for a temperature reversal point further includes increasing the aperture of the outlet diffuser to $K_1$ degrees according to system requirements.

16. The method of claim 12, wherein the step of positively searching for a temperature reversal point further includes:

when the temperature of the outlet diffuser is increased or continuously increased, increasing or continuously increasing the aperture of the outlet diffuser until the aperture of the outlet diffuser reaches an upper limit or the temperature of the outlet diffuser starts to decrease, and determining the aperture of the outlet diffuser at this point to be the temperature reversal point.

17. The method of claim 12, wherein the step of positively searching for a temperature reversal point further includes:

when the temperature of the outlet diffuser is decreased, reducing or continuously reducing the aperture of the outlet diffuser until the aperture of the outlet diffuser reaches a lower limit or the temperature of the outlet diffuser starts to increase, and determining the aperture of the outlet diffuser at this point to be the temperature reversal point.

* * * * *